United States Patent [19]

Benbow

[11] 3,958,372

[45] May 25, 1976

[54] ARTICLE SUPPORTING PANELLING

[76] Inventor: David Benbow, Petitor Works, Torquay, Devon, England

[22] Filed: June 17, 1974

[21] Appl. No.: 480,551

[30] Foreign Application Priority Data

June 19, 1973 United Kingdom..... 29105/73
Oct. 30, 1973 United Kingdom..... 50435/73

[52] U.S. Cl...... 52/36; 52/481
[51] Int. Cl.[2]..... E04B 2/32
[58] Field of Search ..... 52/36, 238, 241, 243, 52/46 D, 468, 481, 482, 582

[56] References Cited

UNITED STATES PATENTS

| | | | |
|---|---|---|---|
| 3,066,774 | 12/1962 | Dahme | 52/36 |
| 3,685,234 | 8/1972 | Nelsson | 52/36 |
| 3,694,975 | 10/1972 | Pollock | 52/36 |
| 3,712,015 | 1/1973 | Nelson | 52/36 |
| 3,778,939 | 12/1973 | Nelsson | 52/481 |

*Primary Examiner*—J. Karl Bell
*Attorney, Agent, or Firm*—Cushman, Darby & Cushman

[57] ABSTRACT

Panelling having channel shaped uprights open to the front and infill panels. The uprights are inset from the infill panels and the web of each upright has slots to receive brackets for supporting shelves or the like.

8 Claims, 8 Drawing Figures

6
25
29
10
2
12
26
12
18
24
32
4
24
22
16
22
16
4
25
28
30
24
10
8
14
12
18
28
26

18
12
12
10
14
2

ARTICLE SUPPORTING PANELLING

This invention relates to article supporting panelling of the kind which is provided with upright rows of slots to which brackets may be removably attached for supporting shelves for example.

Hitherto known panelling of this kind is usually built up with upright slotted metal section members which are individually fastened at spaced intervals along for example the wall of a shop or room. The upright members may be secured to a continous backing, or separate infill panels may span the distance between the upright members and be fixed to them. Commonly the upright members are of channel section opening away from the body of the room with the webs of the channels facing outwards and the infill panels may then be flush or substantially flush with these webs.

According to this invention there is provided panelling having a plurality of spaced apart upright members with rows of slots formed therein, and infill panels extending between the upright members, characterized in that the side edges of the infill panels are arranged closely together and each row of slots is provided in a part of each upright member which is inset from the exterior surface of the infill panels. It is preferred that the panelling is freestanding but is located at the top and bottom preferably in horizontal channel section members.

A plurality of panels and upright members may be made integrally, formed from a single sheet of material. In a preferred construction, however, the upright members and panels are separate integers: the section of the upright member is a narrow channel opening in one direction, for example outwardly towards the room, and the infill panels are each of channel section with their side flanges engaged in the channels of the upright members at each side.

The upright members preferably have a channel depth exceeding the channel width, whereas the infill panels have a channel width exceeding the channel depth by a factor of ten, twenty or even more. The gap between adjacent side edges of infill panels is preferably less than 10 mm, more advantageously less than 5 mm and is yet more preferably in the range 3.0 – 4.5 mm. The infill panels have a width which preferably exceeds 100 mm more preferably it is between 200 and 600 mm.

It is preferred that at least one flange of each infill panel carries a projection, and the each projection on one flange abuts the adjoining flange to separate the remaining parts of the adjoining flanges. More preferably there are projections on both adjoining flanges of adjacent infill panels and these projections abut each other. The areas of contact may be flat portions of the projections, each substantially parallel to the rest of the flange of which it forms part.

One form of panelling made according to this invention will now be described with reference to the accompanying drawings, wherein.

Figures 1, 2:
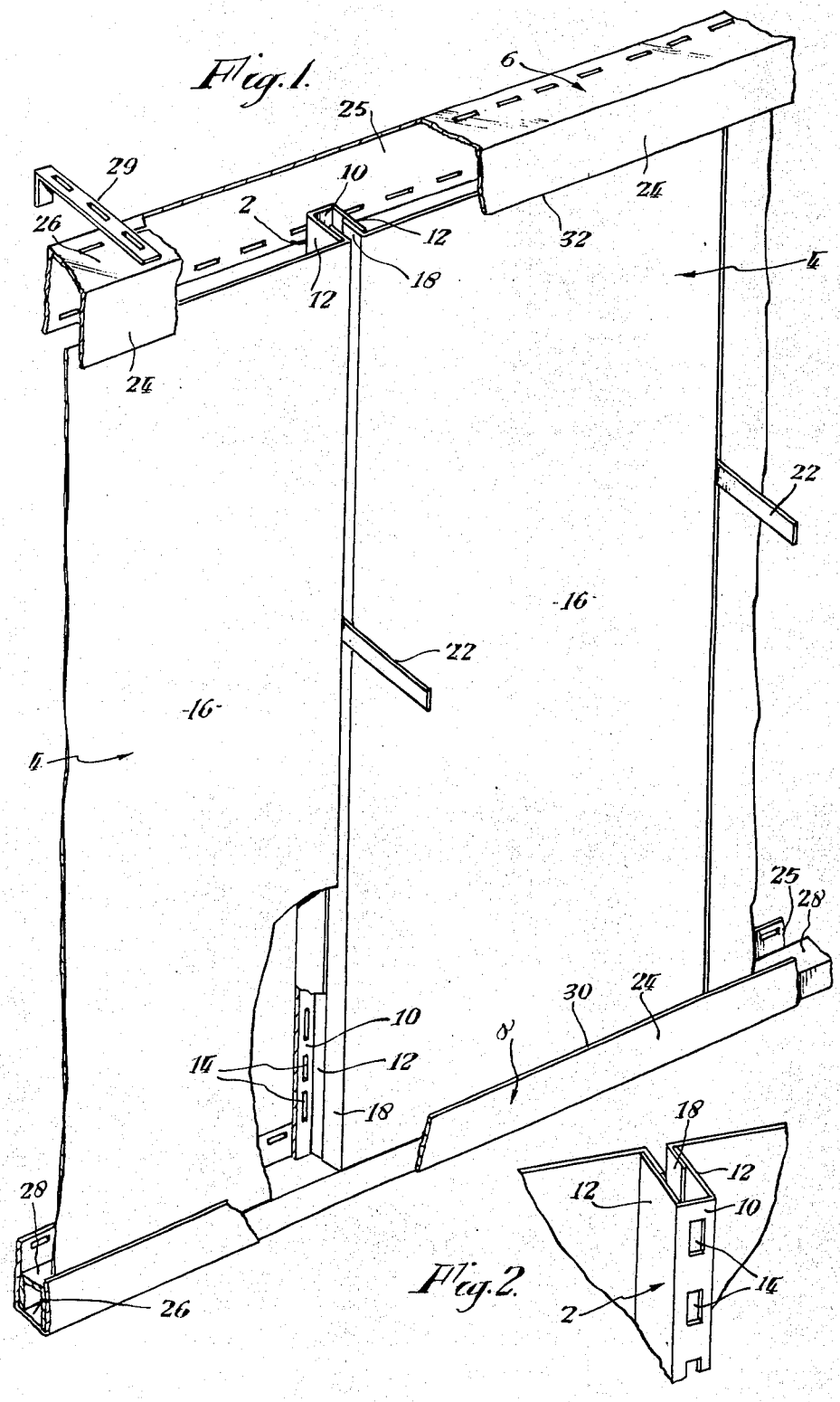
FIG. 1 is a cut-away perspective view of a section of panelling, seen from the side facing into the room.
FIG. 2 is a detail view seen from the reverse side.

Referring first to FIGS. 1 and 2 of the drawings, the panelling has upright members 2 and infill panels 4. The upright members 2 are of simple channel section opening away from the wall, i.e., outwardly towards the room. The channel section is relatively narrow and deep; the depth of the side flanges 12 exceeds the width of the web 10 joining them. The web 10 is formed with a row of longitudinally aligned slots 14 and these are, of course, inset from the exposed surfaces of the infill panels. It is not essential that the web 10 be planar.

Convenient dimensions for the upright members 2 given by way of example only, are that they have a channel width of 7 mm, and a depth of 40–45 mm.; this corresponds to the channel depth exceeding the channel width by a factor of at least two. The slots 14 are 6 mm in width, 19 mm in height and at 40 mm centers.

Figure 3:
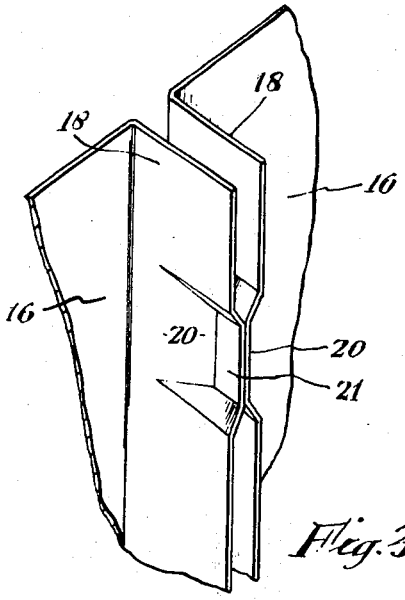
FIG. 3 is a detail view of part of two adjoining infill panels, also seen from the reverse face.

The infill panels 4 are of channel section opening in the opposite direction to the upright members 2, i.e., towards the wall of the room. Each panel 4 has a broad web 16 and side flanges 18. The width of the web 16 is many times greater than the depth of the flanges 18. By preference, the width of the web 16 exceeds the depth of the side flanges 18 by a factor of at least five. The exposed surface of the webs 16 facing the room can advantageously have a decorative finish. The adjoining flanges of two adjacent infill panels fit into the open channel of an upright member 2. The adjoining flanges 18 need to be spaced slightly apart over the greater part of their height and the manner in which this is accomplished is best seen from FIG. 3. Each flange 18 is deformed at one or more points to give a generally tapered projection 20 terminating in a flat 21 substantially parallel to the remainder of the flange 18. The flats 21 of the projections 20 of adjoining panels abut, and space the remainder of the flanges 18 apart.

Brackets 22 may be inserted between the spaced apart adjacent flanges 18, and engaged in one or more of the slots 14, in a manner described in greater detail below. The brackets may for example have a lateral width of 3 to 4 mm to fit between adjacent flanges 3.5 to 4 mm apart.

The panelling is supported in channel section supports 6 and 8 at the top and bottom of the panelling respectively. For convenience the channels 6 and 8 are identical. They have a smooth front flange 24, a slightly deeper back flange 25 and a web 26. The flange 25 and web 26 are perforated with slots and bolt holes for fixing. The bottom channel 8 is fixed to a rigid support, for example to the floor of the room to be panelled. It is fixed horizontally with the channel opening upwardly and is filled for half its depth with a filling 28, in the form of an inverted metal channel which also serves to cover the heads of fastenings passing through the web 26 of the bottom channel. The top channel 6 is fixed at an appropriate height above the bottom channel, opening downwardly towards the bottom channel. The top channel 6 may be fastened directly to the ceiling, or fastened to the wall by means of steel strapping 29 as illustrated.

Once the channels 6 and 8 have been fixed in place, the upright members 2 and infill panels 4 can be inserted into them. Each item is first fitted into the top channel 6 then its lower end is passed over the top edge 30 of the bottom channel 8 and the item allowed to drop onto the filling 28 in the bottom channel. No further fixing is then required and individual infill panels can be removed if desired. Each infill panel has a small hole in the web 16 by which it may be lifted for removal. It will be appreciated that the height of the bottom edge 32 of the top channel over the filling 28 must be less than the height of the upright members 2 and infill panels 4, but the height of the web 26 of the top channel over the edge 30 must be greater than the height of the upright members 2 and infill panels 4.

Figure 5:
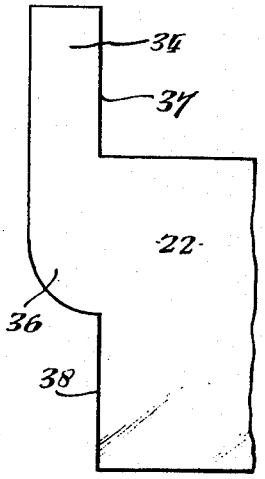
FIG. 5 is a detail of the root of one type of bracket.
Figure 6:
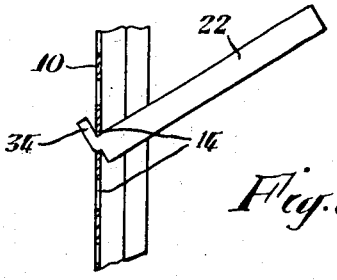
FIG. 6 illustrates the manner in which it is fitted into a slot.
Figure 7:
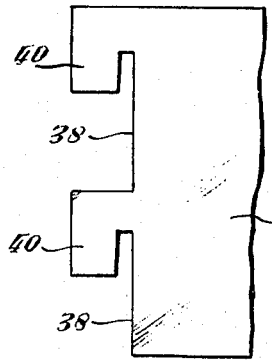
FIG. 7 is a detail of the root of another type of bracket.

The manner in which one type of bracket is engaged in the slots 14 is seen from FIGS. 5 and 6. The root of each bracket 22 terminates in a vertical lug 34, the lower end 36 of which is rounded to form a shoulder. In use, the lug 34 is inserted into a slot 14 at an angle as shown in FIG. 6 and then brought to a horizontal position when the front surface 37 of the lug bears on the back of the web 10 and the rear surface 38 of the bracket bears on the front of the web 10. An alternative bracket is shown in FIG. 7. This has hooks 40 which engage over the lower edges of two of the slots 14. With either type of bracket the root of each bracket, and hence its fixing, is concealed. The panelling supports the bracket against movement from side to side.

Figure 4:
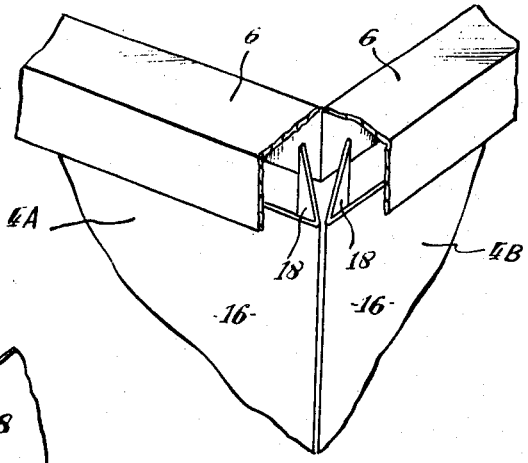
FIG. 4 is a detail view of part of an external corner.

To form an external corner the channels 6 and 8 are mitred. A member which is in effect a narrow infill panel with a vertical right angle bend in the main web can be used to take the panelling around a corner. FIG. 4 shows an alternative construction. Two infill panels 4A, 4B are abutted, the adjoining flanges 18 being bent towards their respective webs 16.

The infill panels may be of various widths to suit individual requirements. However, if the panelling is made up from standard parts, in order to accommodate odd lengths at the end of a run of panelling an infill panel with a web 16 and only one flange 18 can be employed, overlapping a standard infill panel with flanges 18 at both sides of the web 16. At the end of a run of panelling an end capping engaged with the remainder of the panelling can be employed to give a neat finish.

Figure 8:
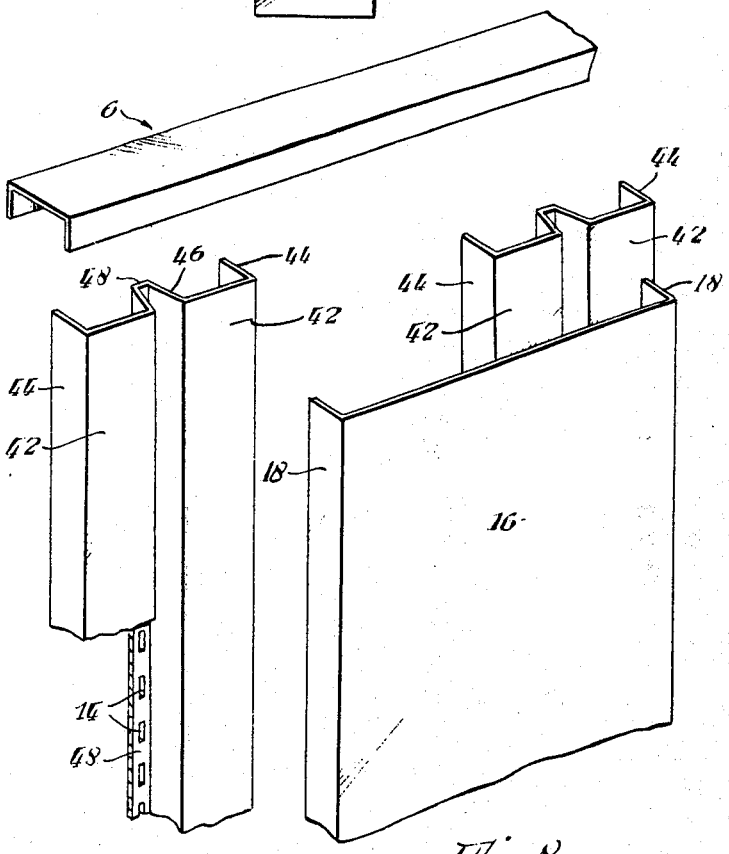
FIG. 8 is an exploded view illustrating a modification.

FIG. 8 illustrates a modification in which the upright members take the form of twin channel sections joined by a rear web set back from the front of the upright this web being either flat or rounded. These upright members each comprise front webs 42 outer flanges 44 and inner flanges 46 joined by a web 48 which is provided with a series of slots 14 running the full length of it.

Various modifications are possible. Several infill panels and inset upright slotted portions may be made in one piece from a single sheet of material. The channels 6 and 8 need not be identical, the bottom channel could be shallower than the top channel, and then the filling 28 dispensed with. Various types of bracket may be employed. The flanges of the upright members and infill panels are shown as being parallel, but might be splayed outwards or inwards slightly.

I claim:

1. Panelling, comprising;

a plurality of infill panels, each infill panel comprising;

a channel section with a front face and two laterally opposite side flanges extending rearwardly therefrom, the infill panels being arranged adjacent one another in series, with the opposite side flanges of each two adjoining infill panels close together; and a plurality of spaced apart upright members;

each upright member comprising:

a narrow channel section having a back wall and two laterally opposite side flanges extending forwardly therefrom;

means defining a vertically extending row of slots in said back wall;

said opposite side flanges of each two adjacent infill panels being received between said opposite side flanges of a respective upright member, the row of slots on each upright member being set back from the front faces of the respective adjacent infill panels and accessible from between said opposite side flanges of the respective adjacent infill panels over at least part of the length of said row, whereby brackets may be secured in the slots and project forwardly beyond said front faces, in which case the close spacing of the adjoining side flanges of the respective adjacent infill panels results in lateral support of the flanges by these side flanges;

at least one side flange of each infill panel carrying a projection, and that projection abutting the respective adjoining infill panel side flange to maintain the adjoining infill panel side flanges separated to provide said close spacing.

2. Panelling according to claim 1 wherein there are projections on both adjoining flanges of adjacent infill panels and these projections abut each other.

3. Panelling according to claim 2 wherein the abutments are flat portions of the projections, each substantially parallel to the rest of the flange of which it forms part.

4. Panelling according to claim 2 wherein the projections are deformations of the flanges.

5. Panelling having first and second opposed vertical faces and comprising:

top and bottom horizontal channel sections open towards each other, said channel sections having fixing means, a plurality of freestanding vertical upright members located in said top and bottom channel sections, each said vertically upright member being a third channel section having a web and side flanges and opening towards said first face of the panelling, the depth of said third channel section exceeding its width by a factor of at least two, the web of said third channel section having a row of vertically aligned slots formed therein;

a plurality of freestanding vertical infill panels also located in said top and bottom channel sections and extending between said vertically upright members, each infill panel being a fourth channel section having a web and side flanges and opening towards said second face of the panelling, the width of said fourth channel section exceeding its depth by a factor of at least five, the adjoining side flanges of adjacent infill panels being received within the channel of a said vertically upright member, the side flanges bearing abutting aligned projections whereby the remaining parts of the adjoining side flanges are spaced slightly apart.

6. Panelling according to claim 5 wherein the infill panels and vertically upright members both extend into the top horizontal channel section by an amount which leaves a clearance above them between their upper edges and the web of the said horizontal channel section, said clearance exceeding the amount by which the infill panels and vertically upright members extend into said bottom horizontal channel section, whereby the vertically upright members and infill panels may be lifted into and out of the top and bottom horizontal channel sections.

7. Panelling, comprising:

top and bottom support means, a plurality of infill panels, each infill panel comprising:

a channel section with a front face and two laterally opposite side flanges extending rearwardly therefrom, the infill panels being arranged adjacent one another in series, with the opposite side flanges of each two adjoining infill panels close together; and a plurality of spaced apart upright members;

each upright member comprising:

a narrow channel section having a back wall and two laterally opposite side flanges extending forwardly therefrom to define a narrow forwardly facing channel therefrom;

means defining in said back wall a vertically extending row of slots for supporting forwardly projecting brackets;

said opposite side flanges of each two adjacent infill panels being received in said forwardly facing narrow channel between said opposite side flanges of a respective upright member, the infill panels and upright members being freestanding between the top and bottom support means, and the row of slots on each upright member being set back from the front faces of the respective adjacent infill panels and accessible from between said opposite side flanges of the respective adjacent infill panels over at least part of the length of said row.

8. Panelling, comprising:

a plurality of infill panels, each infill panel comprising:

a channel section with a front face and two laterally opposite side flanges extending rearwardly therefrom, the infill panels being arranged adjacent one another in series, with the opposite side flanges of each two adjoining infill panels close together; and a plurality of spaced apart upright members;

each upright member comprising:

a narrow channel section having a back wall and two laterally opposite side flanges extending forwardly therefrom;

means defining a vertically extending row of slots in said back wall;

said opposite side flanges of each two adjacent infill panels being received between said opposite side flanges of a respective upright member, the row of slots on each upright member being set back from the front faces of the respective adjacent infill panels and accessible from between said opposite side flanges of the respective adjacent infill panels over at least part of the length of said row, whereby brackets may be secured in the slots and project forwardly beyond said front faces, in which case the close spacing of the adjoining side flanges of the respective adjacent infill panels results in lateral support of the flanges by these side flanges;

each upright member being constituted by twin channel sections disposed side-by-side, each having a front wall and an outer side flange extending rearwardly therefrom;

said narrow channel section being shared by and between the two channel sections with the two laterally extending side flanges of the narrow channel section extending rearwardly from the two respective twin channel section front walls.

* * * * *